US006081925A

United States Patent [19]

Reiber

[11] Patent Number: 6,081,925

[45] Date of Patent: Jul. 4, 2000

[54] METHOD FOR HOLDING A SLEEVE

[76] Inventor: Mark A. Reiber, 11725 Darbyshire Ct., Loveland, Ohio 45140

[21] Appl. No.: 09/226,305

[22] Filed: Jan. 7, 1999

Related U.S. Application Data

[60] Provisional application No. 60/070,811, Jan. 8, 1998.

[51] Int. Cl.[7] ..... A41B 1/08

[52] U.S. Cl. ..... 2/125; 2/321; 2/920

[58] Field of Search ..... 2/125, 126, 289, 2/270, 920, 321, 311, 312, 317, 338, 170, 171, 115, 113, 69, DIG. 11; 24/306, 442

[56] References Cited

U.S. PATENT DOCUMENTS

| | | | |
|---|---|---|---|
| 170,641 | 11/1875 | Perego . | |
| 209,413 | 10/1878 | Moses . | |
| 237,096 | 2/1881 | Delmonte . | |
| 261,318 | 7/1882 | Dobbs . | |
| 280,167 | 6/1883 | Ford . | |
| 322,397 | 7/1885 | Roggen et al. . | |
| 461,434 | 10/1891 | Henry . | |
| 642,653 | 2/1900 | Webber . | |
| 823,534 | 6/1906 | Hutchinson . | |
| 1,199,950 | 10/1916 | Weary . | |
| 1,648,776 | 11/1927 | McOrin | 2/305 |
| 2,153,068 | 4/1939 | Arden . | |
| 4,047,651 | 9/1977 | McMullen | 224/4 D |
| 4,384,583 | 5/1983 | Speelman et al. | 128/327 |
| 4,475,252 | 10/1984 | Peyser et al. | 2/125 |
| 4,521,922 | 6/1985 | Mitchell et al. | 2/171 |
| 4,557,215 | 12/1985 | Petersson | 116/222 |
| 4,698,854 | 10/1987 | Slimmon | 2/338 |
| 4,825,475 | 5/1989 | Smart . | |
| 4,837,860 | 6/1989 | Roberts et al. | 2/51 |
| 4,991,234 | 2/1991 | Greenberg | 2/170 |
| 5,142,743 | 9/1992 | Hahn | 24/442 |
| 5,555,561 | 9/1996 | Plachta et al. | 2/2 |
| 5,649,954 | 7/1997 | McEwen | 606/202 |
| 5,652,961 | 8/1997 | Knight-Yurt | 2/114 |
| 5,692,239 | 12/1997 | Lewis . | |
| 5,787,511 | 8/1998 | Garside . | |

FOREIGN PATENT DOCUMENTS

| | | |
|---|---|---|
| 597852 | 4/1978 | Switzerland . |
| 2219187 | 12/1989 | United Kingdom . |

*Primary Examiner*—John J. Calvert
*Assistant Examiner*—Tejash Patel
*Attorney, Agent, or Firm*—Robert H. Eichenberger

[57] ABSTRACT

A sport sleeve holder for releasibly retaining a sleeve atop a user's shoulder comprises a strap of material, having two sides and two ends, the strap being sufficiently flexible so that one end of the strap may be positioned adjacent the opposite end of the strap. Preferably, the strap comprises polypropylene web material. The sport sleeve holder has a fastening mechanism coupled to each end of the strap at opposite sides thereof. The fastening mechanism preferably comprises cooperating hook and loop fastener fabric. The sport sleeve holder may also have a label coupled to the upper side of the strap, which label may contain graphics or other logos. Preferably, the label comprises a textile which is 70% cotton and 30% nylon. A method of using the sport sleeve holder comprises inserting the sport sleeve holder through either the sleeve opening or the neck opening of a shirt so that the upper side of the sport sleeve holder faces the user's shoulder. The user then forms the sport sleeve holder into a loop by bringing one end of the sport sleeve holder into proximity with the other end so that the sleeve is disposed inside the loop. The user then couples the two ends of the strap by activating the fastening mechanism to join the ends.

13 Claims, 3 Drawing Sheets

METHOD FOR HOLDING A SLEEVE

CROSS-REFERENCE TO RELATED APPLICATIONS

This application claims priority from U.S. provisional application Ser. No. 60/070,811 filed on Jan. 8, 1998.

STATEMENT REGARDING FEDERALLY SPONSORED RESEARCH OR DEVELOPMENT

Not applicable

BACKGROUND OF THE INVENTION

This invention relates to shirts and other garments which are worn on a person's torso. More specifically, this invention relates to sleeved garments and devices which are used to prevent the sleeves from interfering with a user's active lifestyle.

Frequently in the field of athletics, participants desire to roll up, gather, or otherwise retain their shirt sleeves atop their shoulders so as to afford more movement, improved flexibility, or simply increased exposure for their arms. Gathered shirt sleeves can afford a better range of arm motion for participants in various athletic activities as well as in various everyday non-athletic activities. However, as participants move about during the course of the activity, the gathered sleeves tend to "unroll," fall, or slide back down the participant's arm. Such occurrence requires the participant to take time to re-roll or re-gather the sleeves to the retained position. But, with continual movement and activity, the sleeves eventually fall back down. Again, this cycle of rolling and re-rolling (or gathering or re-gathering) the sleeves occurs numerous times during the activities. This causes delays of games, periods of inattentiveness, and general frustration on the part of the participant and others associated with the athletic event.

As mentioned above, however, athletes are not the only persons who may desire to retain their shirt sleeves atop their shoulders. People who engage in everyday activities including, but not limited to, various types of work activities, non-competitive athletic activities, as well as leisure activities also frequently desire the greater range of arm motion or greater exposure afforded by gathered shirt sleeves. Again, however, similar problems of sleeve-unrolling exist for these activities as well.

For the foregoing reasons, there is a need for a device which simply, effectively, and removably secures a person's sleeve on his or her shoulder in order to achieve comfort, flexibility, movability, and exposure.

BRIEF SUMMARY OF THE INVENTION

The present invention is directed to a device that satisfies the need to securely but removably retain a person's sleeve on his or her shoulder. The sport sleeve holder comprises an elongate strap of at least one layer of material having an upper side and a lower side, and having a first end and a second end. Numerous materials are available for the strap, including substantially any textile material, polymeric material, or any material suitable for use as a clothing accessory. The sport sleeve holder is fitted on alternate sides at each end with a fastening mechanism for fastening the strap back onto itself. The fastening mechanism can be any type of fastening structure readily adaptable to the strap material. In the preferred embodiment, the fastening mechanism comprises cooperating strips of hook and loop fastener fabric.

The sport sleeve holder may further contain a label coupled to the upper side of the strap; however, a label is not required. The label may overlay the entire upper side of the strap, or the label may overlay only a portion of the upper side of the strap. Numerous materials are available for the label, if any, and include substantially the same types of materials as available for the strap.

Additionally, various methods of coupling the label to the strap are available. These include, but are not limited to, the following: mechanical methods (such as sewing, stapling, buttoning, snapping, and the like); chemical methods (such as gluing or otherwise adhering one material to another); and physical methods (such as stamping, heat sealing, and the like).

In the preferred embodiment, the sport sleeve holder comprises a strap of polypropylene and the fastening mechanism comprises strips of cooperating hook and loop fastener fabric coupled to opposite sides at opposite ends of the strap. Also in the preferred embodiment, a label of 70% cotton and 30% nylon is coupled to the upper side of the strap by sewing.

The preferred embodiment provides simple, effective retention of a shirt sleeve atop a user's shoulder. In one method of use, the user can roll up or gather his or her sleeve atop the shoulder. Where the user rolls up the sleeve, the rolling can be done in a fashion such that the rolls are either on the outside or on the inside of the sleeve. The user inserts the sport sleeve holder through either the neck opening or the sleeve opening of a shirt such that the sport sleeve holder is positioned between the shoulder and the gathered sleeve and the strap is elongated in a direction substantially parallel to the user's shoulders. The user takes the second end of the sport sleeve holder (having one strip of hook and loop fastener fabric), wraps the sport sleeve holder around the gathered sleeve, and fastens the second end to the first end of the sport sleeve holder (having a strip of cooperating hook and loop fastener fabric), thereby encircling the gathered shirt sleeve. In this condition, the sport sleeve holder forms a loop through which the gathered sleeve passes. Now the rolled-up sleeve is securely retained atop the user's shoulder, and the user can proceed to move and be active without the sleeve unrolling or falling back down the arm.

Likewise, the user can retain a shirt sleeve with the sport sleeve holder without first gathering the sleeve. In this method, the user inserts the sport sleeve holder through either the neck opening or the sleeve opening of a shirt such that the sport sleeve holder is positioned between the shoulder and the gathered sleeve and the strap is elongated in a direction substantially parallel to the user's shoulders. The user forms the sport sleeve holder into a loop by bringing one end of the sport sleeve holder into proximity with the other end so that the sleeve is disposed inside the loop. The user then connects the two ends by activating the fastening mechanism. In the preferred embodiment, the user connects the two ends by pressing the hook fastener fabric on one end against the loop fastener fabric on the other end. By bringing the two ends together, the sport sleeve holder forms a loop around the sleeve, and in the process, the sport sleeve holder gathers the sleeve. Once the two ends are fastened, the user can proceed to move and be active without the sleeve unrolling or falling back down the arm.

As can be seen, an object of this invention is to provide a device which securely retains a sleeve atop a user's shoulder while providing the user with maximum range of motion for the arms.

Another object of this invention is to provide a device which is simply releasible so as to be removed when not in use.

A further object of this invention is to provide a device which securely retains a sleeve atop a user's shoulder but which requires no attachments or additional appurtenances to the sleeve or the garment to which the invention is applied.

These and other objects and advantages of this invention will become apparent upon reading the following description, of which the attached drawings form a part.

DETAILED DESCRIPTION OF THE INVENTION

This invention can be better understood by reference to the drawings. For the sake of brevity, the garment which is retained by this invention is referred to as a shirt. However, it is to be understood as briefly described above that this invention can be used in cooperation with any sleeved garment.

Figure 1:
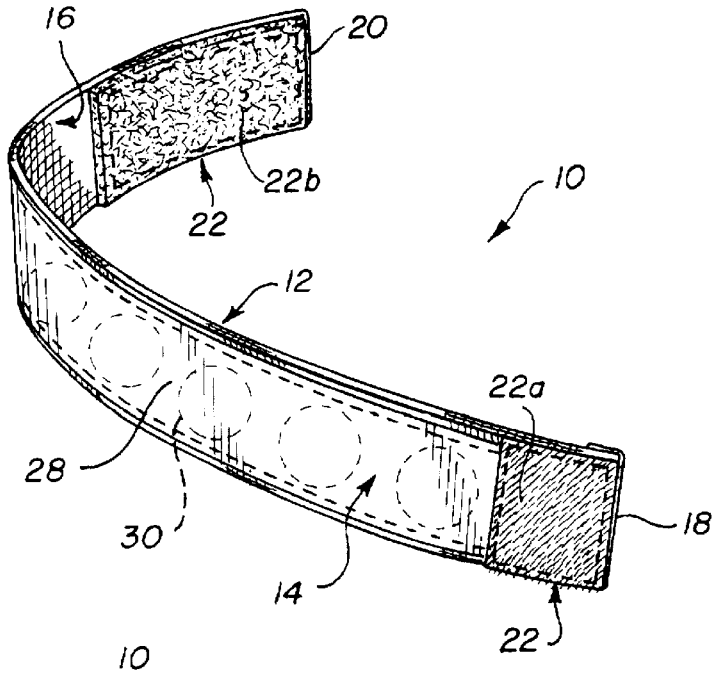
FIG. 1 is a perspective view of the sport sleeve holder of the present invention.

Referring now to the drawings wherein like numerals indicate like elements, there is shown in FIG. 1 a sport sleeve holder 10. The sport sleeve holder 10 comprises an elongate strap 12 of material having an upper side 14 and a lower side 16 and a first end 18 and a second end 20. The strap 12 may be made of any fabric or textile, elasticized or non-elasticized. The strap 12 may comprise a single layer of material or more than one layer of material. Suitable materials for the strap are numerous, and some desirable properties exist which will help (but which are not functional prerequisites) in the selection of suitable materials. These properties include, but are not limited to, the following: durability, structural integrity, stain resistance, and flexibility. The material preferably should be sufficiently durable so as to be capable of repeated use without ripping, tearing, breaking, or otherwise failing. Also, the material preferably should be sufficiently resistant to permanent disfigurations after repeated use. This means that, upon application of tensile or torsional forces of a magnitude which a human can apply to a shirt without the use of tools, the material preferably should not be capable of permanent deformations. This is especially true for elasticized material, where one of the benefits of an elasticized material lies in the ability of the material to "spring back" into its original shape. Additionally, the material preferably should be resistant to stains, soiling, fading, and the like so as to be able to retain its appearance after repeated use. At the same time, the material should preferably be sufficiently flexible so that the ends 18, 20 of the strap 12 can easily be manipulated to allow the first end 18 to be positioned adjacent the second end 20. Given these and other factors, suitable materials include substantially any textile material, polymeric materials, or other fabric which would be suitable as an accessory to clothing. In addition, a preferable feature for the material for the strap 12 is that the material be sufficiently soft or smooth so as to minimize irritation or abrasion to the user. In the preferred embodiment, the strap 12 is of a single layer of polypropylene web material.

Figure 5:
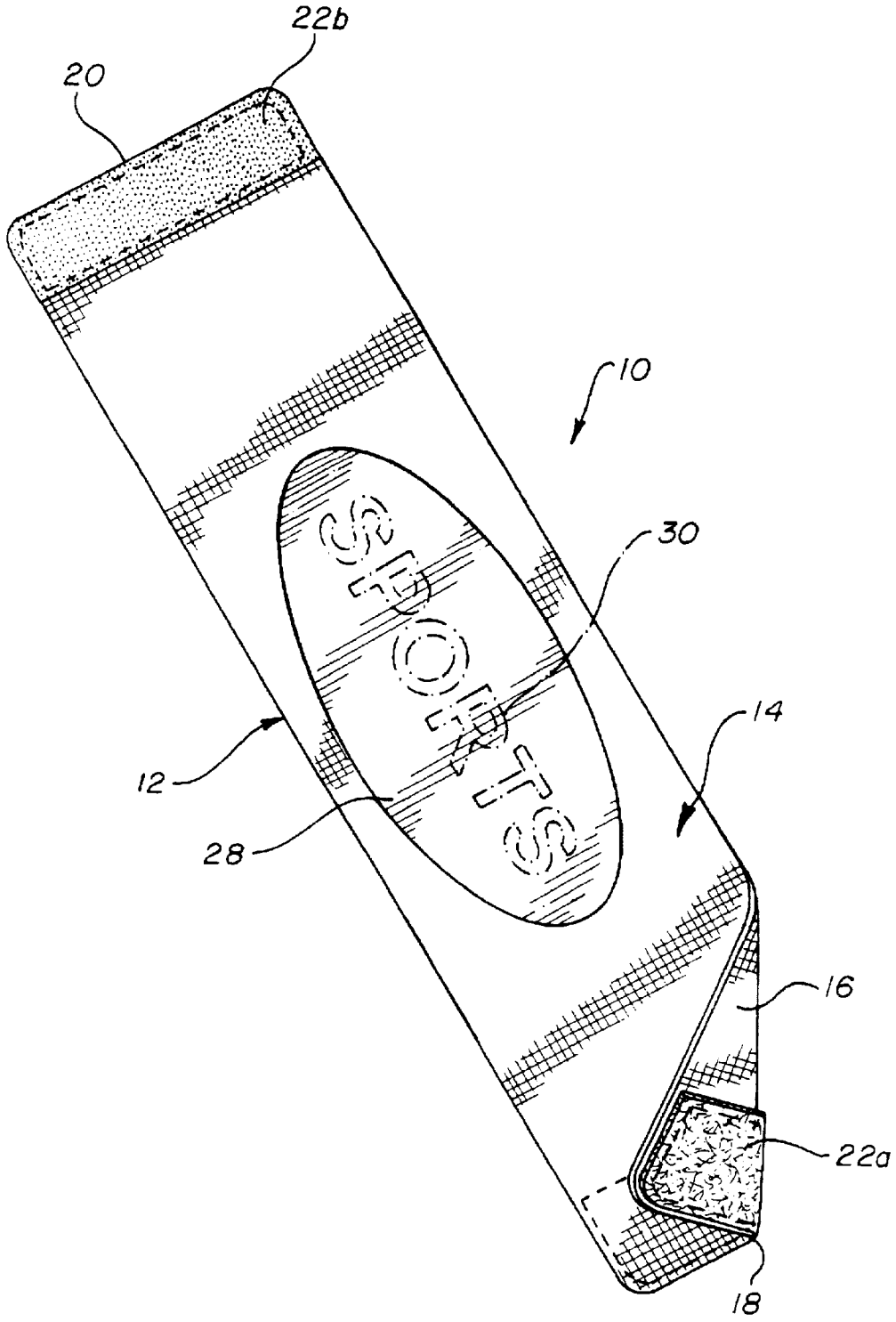
FIG. 5 is a perspective view of a first alternative embodiment of the sport sleeve holder of the present invention.

Referring now to FIG. 5, a first alternative embodiment of the sleeve holder 10 comprises a strap 12 of a laminated elastic textile fabric for use in making clothing and other industrial uses, sold under the trademark DARLEXX and manufactured by Yarida Sporting Goods Company, Limited, Kaohsiung, Taiwan, ROC. In a second alternative embodiment, not shown, the strap 12 is of nylon/polyester blend.

Figure 2A:
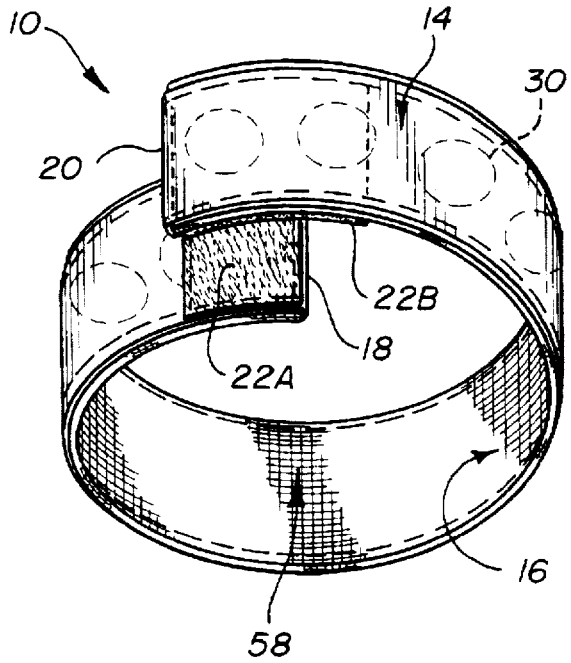
FIG. 2*a* is a perspective view of the sport sleeve holder of the present invention as seen from the bottom inside.
Figure 2B:
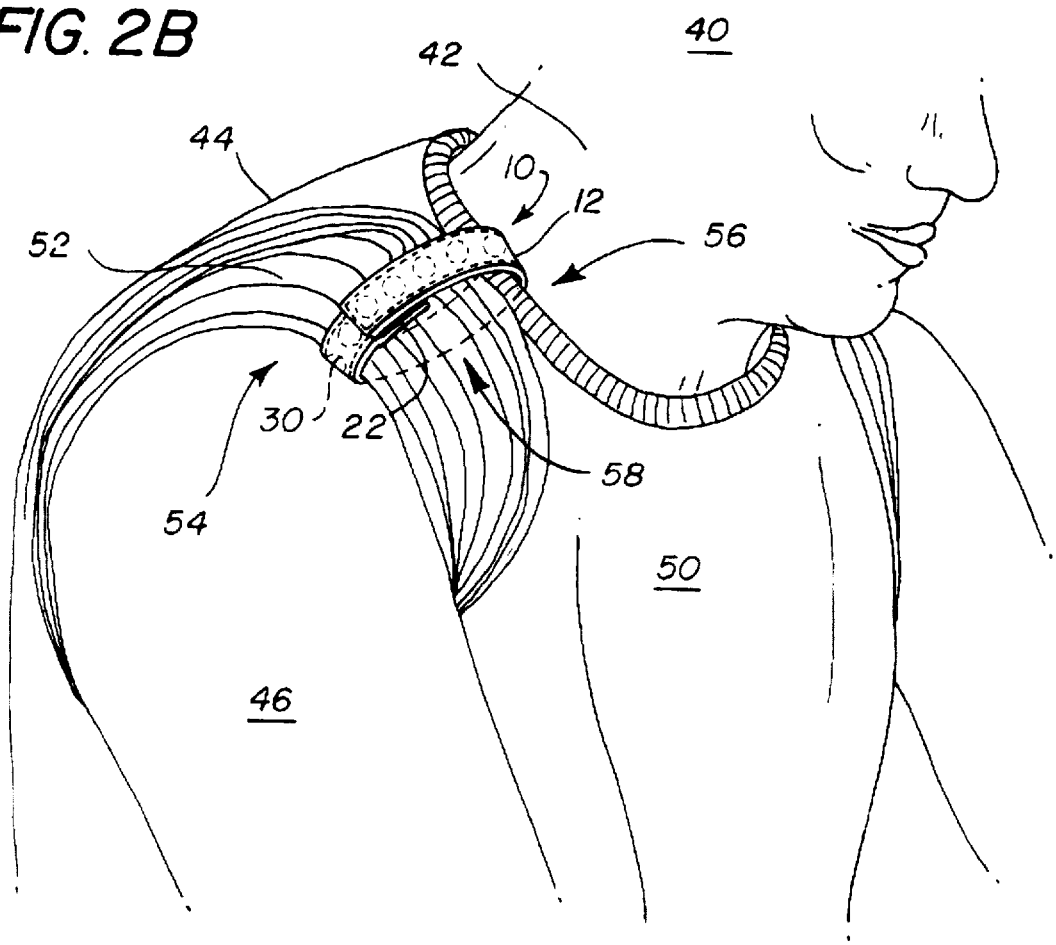
FIG. 2*b* is a perspective view of the sport sleeve holder of the present invention in use.

Referring now to FIGS. 2*a* and 2*b*, the size of the sport sleeve holder 10 is determined by the size of the strap 12. The strap 12 may be of various lengths and widths, depending on several factors. Some of these factors include, but are not limited to, the following: the activity engaged in by a user 40 of the sport sleeve holder 10, the gender of the user 40, the physical size of the user 40, and the personal preferences of the user 40. For instance, an adult might desire a sport sleeve holder 10 that is wider and longer than a sport sleeve holder 10 used by a small child. Also, a male might prefer a wider or longer sport sleeve holder 10 than might a female. Similarly, a person engaged in an activity which requires frequent and strenuous arm movements (like, for instance, basketball or volleyball) might prefer a longer or wider sport sleeve holder 10 than would a leisure activity which requires only small arm movements (like, for instance, sunbathing). It should be noted that possible size ranges of the strap 12 also depend on the type of material used for the strap 12. A strap 12 of a material which has a high yield strength might be functionally capable of a narrower width than a strap 12 of a material which has a lower yield strength. In the preferred embodiment, the strap 12 measures approximately 1 inch wide by approximately 6⅞ inches long. In the first alternative embodiment in which the strap 12 is of DARLEXX, as described above, the strap 12 measures approximately 2 inches wide by approximately 8 inches long.

A fastening mechanism 22 comprises a male member 22*a* and a cooperating female member 22*b*. The fastening mechanism 22 may be of any type commonly known in the art. It is to be noted that the functional requirements of the sport sleeve holder 10 require only that the male member 22*a* and the female member 22*b* be disposed generally at the ends 18, 20 of the strap 12. Typically, the fastening mechanism 22 is coupled to alternate sides 14, 16 of the strap 12 at opposite ends 18, 20 of the strap 12. This arrangement allows the male member 22*a* to engage the female member 22*b*, so that the sport sleeve holder 10 thereby forms a loop 58 when ends 18 and 20 are connected. The fastening mechanism 22 can overlay substantially the entire width of the strap 12, or only a portion thereof In the preferred embodiment, the fastening mechanism 22 comprises cooperating strips of hook and loop fastener fabric, wherein the male member 22*a* is a strip of hook fabric, and the female member 22*b* is a strip of loop fabric. Also, in the preferred embodiment, the male member 22*a* and the female member 22*b* extend substantially the entire width of the strap 12. More specifically, the width of the male member 22*a* and of the female member 22*b* is approximately 1 inch in the preferred embodiment. In the first alternative embodiment in which the strap 12 is of DARLEXX, as described above, the width of the male member 22*a* and of the female member 22*b* is approximately 2 inches.

In the preferred embodiment, the male member 22*a* and the female member 22*b* are coupled to alternate sides 14, 16 of the strap 12 at opposite ends 18, 20 thereof. It should be noted that the sport sleeve holder 10 will function properly whenever the male member 22*a* and the female member 22*b* are coupled to opposite ends 18, 20 and opposite sides 14, 16 of the strap 12. Stated differently, in the preferred embodiment, the sport sleeve holder 10 will function properly if the male member 22*a* were coupled to the upper side 14 of the first end 18 of the strap 12 and the female member 22*b* were coupled to the lower side 16 of the second end 20 of the strap 12. Likewise, the sport sleeve holder 10 will function properly if the female member 22*b* were coupled to the upper side 14 of the first end 18 of the strap 12 and the male member 22*a* were coupled to the lower side 16 of the second end 20 of the strap 12.

A third alternative embodiment, not shown, is contemplated in which male member 22*a* actually comprises the material of the strap 12, and in which the female member 22*b* of the fastening mechanism 22 can cooperate with and releasibly secure the strap 12. An example of such a device may be where the strap 12 comprises a cord-like material, and the male member 22*a* further comprises the first end 18 of the strap 12, and the female member 22*b* further comprises a means for releasibly retaining the cord-like material which comprises the strap 12.

The length of the sport sleeve holder 10 preferably is adjustable so as to adjust the size of the loop 58 formed by joining first end 18 and second end 20. Adjustability of the sport sleeve holder 10 can be beneficial to the user 40 to better retain sleeves of varying materials and of varying sizes. In addition, adjustability is further beneficial in allowing the user 40 to vary the size of the loop 58. In the preferred embodiment, the fastening mechanism 22 provides the adjustability. Generally, the longer the fastening mechanism 22, the more adjustable the sport sleeve holder 10. In the preferred embodiment, the length of the male member 22*a*, the female member 22*b*, or both, may be altered to provide an adjustment structure 60 which will allow slight adjustments in the size of the loop 58. Specifically, in the preferred embodiment, the female member 22*b* is more elongated than is the male member 22*a*. More specifically, in the preferred embodiment, the female member 22*b* measures approximately 1½ inches in length, whereas the male member 22*a* measures approximately 1 inch in length. The added length of the female member 22*b* provides the user 40 with at least approximately ½ inch more adjustment capability than a sport sleeve holder 10 where both members 22*a* and 22*b* are only 1 inch in length.

In the first alternative embodiment in which the strap 12 is of DARLEXX, as described above, and in which the width of the members 22*a* and 22*b* is approximately 2 inches, members 22*a* and 22*b* each measure approximately ⅝ inch in length. The elasticized material for the strap 12 of the first alternative embodiment provides the adjustability.

Figure 3:
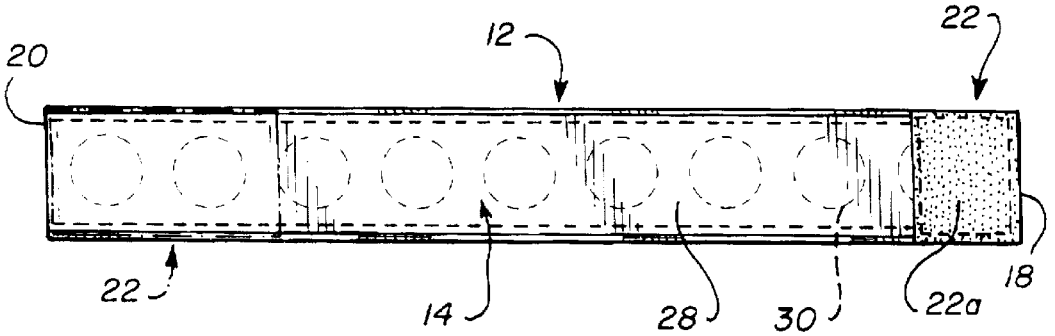
FIG. 3 is a front elevational view of the sport sleeve holder of the present invention.
Figure 4:
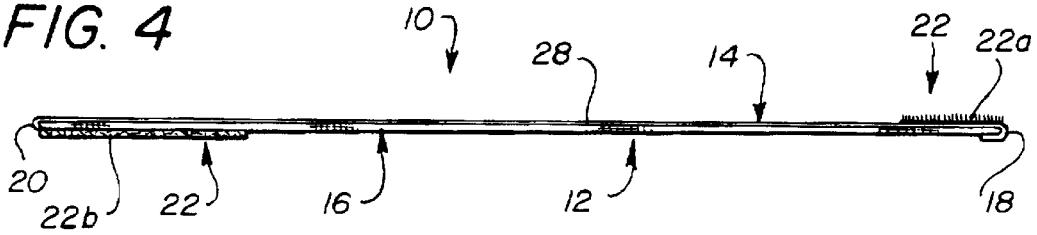
FIG. 4 is a top plan view of the sport sleeve holder of the present invention.

Referring now to FIG. 3 and FIG. 4, a label 28 may be coupled to the strap 12 and disposed on the upper side 14 thereof. The label 28 may be of substantially any material in any color. The method of coupling the label 28 to the strap 12 may be any method known in the art for the particular materials used for the strap 12 and the label 28. Suitable methods of coupling can include mechanical processes (for instance, where some structure is utilized to hold the label 28 to the strap 12); chemical processes (for instance, where at least one chemical compound is used to adhere the label 28 to the strap 12); and physical processes (for instance, where a physical force is used to join the label 28 to the strap 12). The label 28 may contain graphics 30 which pertain to any sport for which the user 40 might utilize the sport sleeve holder 10. In addition, the label 28 may contain graphics 30 related to schools, colleges, organizations, athletic associations, and the like in which organizations the user 40 might utilize the sport sleeve holder 10. Furthermore, the label 28 may contain graphics 30 which refer to products, services, manufacturers, advertising, and the like. The label 28 may completely overlay the strap 12, or may overlay only a portion of the strap 12.

The label 28 preferably should be made of a material which is not irritative or abrasive to the user 40. In the preferred embodiment, the label 28 is of a fabric which comprises 70% cotton and 30% polyester, and the label 28 is sewed to the upper side 14 of the strap 12 so as to overlay substantially the entire upper side 14 of the strap 12. Also in the preferred embodiment, the graphics 30 are coupled to the label 28 by silk screen procedures. In the first alternative embodiment, the label 28 comprises polyvinyl chloride and is coupled to the upper side 14 of the strap 12 by adhesives or heat-sealing procedures. In the second alternative embodiment, not shown, the label 28 comprises thread material wherein the label 28 is coupled to the strap 12 by stitching the thread material through the strap 12. In this alternative, the label 28 appears as embroidery.

FIG. 2*b* illustrates a sport sleeve holder 10 of the present invention as it appears when in use. FIG. 2*b* depicts only a partial perspective view of a user 40 and indicates, generally, a neck 42, a shoulder 44, and an arm 46, it being understood that a user 40 typically has two shoulders 44 and two arms 46, such that a single user 40 could utilize multiple sport sleeve holders 10. A shirt 50 contains, generally, a sleeve 52, a sleeve opening 54, and a neck opening 56, again it being understood that FIG. 4 depicts only a partial view of a user 40.

One method of using the sport sleeve holder 10 begins with the user 40 rolling up or otherwise gathering the sleeve 52 of the shirt 50 atop the shoulder 44 of the user 40. The user 40 inserts the sport sleeve holder 10 through either the sleeve opening 54 or the neck opening 56 of a shirt 50 such that (i) the sport sleeve holder 10 is positioned between the shoulder 44 and the gathered sleeve 52; (ii) the upper side 14 of the strap 12 faces the shoulder 44; (iii) the strap 12 is elongated in a direction substantially parallel to the shoulders 44; and (iv) the first end 18 is toward the neck 42. The user 40 then forms the sport sleeve holder 10 into a loop 58 by bringing the first end 18 into proximity with the second end 20 so that the sleeve 52 is disposed inside the loop 58. The user 40 then connects the ends 18, 20 by activating the fastening mechanism 22. In the preferred embodiment, the user 40 releasibly attaches ends 18, 20 by mating the male member 22*a* with the female member 22*b*. The result is that the sport sleeve holder 10 encircles the gathered sleeve 52 of the user 40, and the strap 12 remains releasibly attached to itself until the user 40 is ready to remove the sport sleeve holder 10. When installed in this manner, the label 28, if any, and the graphics 30, if any, will be readily readable by observers. It should be noted that alternative embodiments of the sport sleeve holder 10 may contain no label 28, or may contain a label 28 or graphics 30 in which the orientation is irrelevant in order for observers to comprehend the effect of the label 28 or of the graphics 30. In these cases, it is irrelevant whether the first end 18 or the second end 20 is toward the neck 42. It should be recalled that any method of attaching the strap 12 to itself would be functionally acceptable so long as the sleeve 52 is encircled thereby.

Another method of using the sport sleeve holder 10 exists wherein the user 40 need not first gather the sleeve 52. In this method, the user 40 inserts the sport sleeve holder 10 through either the sleeve opening 54 or the neck opening 56 of a shirt 50 such that (i) the sport sleeve holder 10 is positioned between the shoulder 44 and the sleeve 52; (ii) the upper side 14 of the strap 12 faces the shoulder 44; (iii) the strap 12 is elongated in a direction substantially parallel to the shoulders 44; and (iv) the first end 18 is toward the neck 42. The user 40 then forms the sport sleeve holder 10 into a loop 58 by bringing the first end 18 into proximity with the second end 20 so that the sleeve 52 is disposed inside the loop 58. The user 40 then connects the ends 18, 20 by activating the fastening mechanism 22. In the preferred embodiment, the user 40 releasibly attaches ends 18, 20 by mating the male member 22*a* with the female member 22*b*. When installed in this manner, the label 28, if any, will be readily readable by observers. It should be noted that alternative embodiments of the sport sleeve holder 10 may contain no label 28, or may contain a label 28 in which the orientation is irrelevant in order for observers to comprehend the effect of the label 28. In these cases, it is irrelevant whether the first end 18 or the second end 20 is toward the neck 42.

The sport sleeve holder 10 can be easily manufactured in various ways depending on the materials selected for the strap 12, the fastening mechanism 22, and the label 28, if any. Manufacturing the sport sleeve holder 10 comprises, generally, assembling the various component parts. In the preferred embodiment, a label 28 is prepared with the desired graphics 30, if any, by silk screening. The label 28 is sized according to preference so that the label 28 overlays substantially the entire upper side 14, or overlays only a portion thereof. The male member 22*a* is placed at the preferred end 18,20 and the female member 22*b* is placed at the alternate end 20, 18 respectively. The sport sleeve holder is then sewed around its perimeter to secure the label 28 and the fastening mechanism 22. Additional stitching of the label 28 or of the fastening mechanism 22 may be used for added strength or durability.

While the invention has been described with reference to specific embodiments, modifications and variations of the invention may be constructed without departing from the scope of the invention, which is defined in the following claims.

What is claimed is:

1. A method of securing a sleeve comprising:

a) providing a strap comprising an upper side and a lower side and first and second ends, and at least one layer of material, wherein said upper and lower sides are relatively smooth uninterrupted surfaces;

b) providing said first and second ends with respective first and second fastening mechanisms coupled to said strap on opposite sides thereof and where neither of said fastening mechanisms traverses the entire length of said strap;

c) placing said strap between a user's shoulder and a garment sleeve such that said strap is elongated in a direction substantially parallel to said user's shoulder;

d) placing said first end of said strap and said second end of said strap into proximity with one another; and d) fastening said first end of said strap to said second end of said strap by engaging said first fastening mechanism with said second fastening mechanism.

2. The method of securing a sleeve as recited in claim 1, wherein said first fastening mechanism and said second fastening mechanism further comprise cooperating strips of hook and loop fastener fabric.

3. The method of securing a sleeve as recited in claim 1, wherein said strap further comprises a label coupled to said upper side of said strap.

4. The method of securing a sleeve as recited in claim 1, wherein said label further comprises textile material.

5. The method of securing a sleeve as recited in claim 4, wherein said label is coupled to said upper side of said strap by sewing.

6. The method of securing a sleeve as recited in claim 1, wherein said label further comprises polyvinyl chloride material.

7. The method of securing a sleeve as recited in claim 6, wherein said label is coupled to said upper side of said strap by adhesively joining said label to said strap.

8. The method of securing a sleeve as recited in claim 1, wherein said label further comprises thread material.

9. The method of securing a sleeve as recited in claim 8, wherein said label is coupled to said upper side of said strap by stitching said thread material through said strap.

10. In combination with a sleeved garment, a sport sleeve holder comprising:

a strap, having an upper side and a lower side and a first end and a second end, said strap further comprising at least one layer of material, said upper side and said lower side consisting of relatively smooth surfaces; and a first fastening mechanism coupled to said upper side of said first end of said strap, and a second fastening mechanism coupled to said lower side of said second end of said strap, wherein neither said first fastening mechanism nor said second fastening mechanism traverses the entire length of said strap.

11. The sport sleeve holder as recited in claim 10, further comprising a label coupled to said upper side of said strap.

12. A method of securing a sleeve comprising:

a) providing a strap comprising an upper side and a lower side and a first end and a second end, said strap comprising at least one layer of material, wherein said upper side and said lower side are relatively smooth uninterrupted surfaces;

b) providing said first end with a first fastening mechanism coupled to said upper side and said second end with a second fastening mechanism coupled to said lower side;

c) providing said strap with a label coupled to said upper side of said strap;

d) placing said strap between a user's shoulder and a garment sleeve such that said strap is elongated in a direction substantially parallel to said user's shoulder;

e) placing said first end of said strap and said second end of said strap into proximity with one another; and f) fastening said first end of said strap to said second end of said strap by engaging said first fastening mechanism with said second fastening mechanism.

13. The method of securing a sleeve as recited in claim 12, wherein said first fastening mechanism and said second fastening mechanism further comprise cooperating strips of hook and loop fastener fabric.

* * * * *